US009828661B2

(12) United States Patent
Kim et al.

(10) Patent No.: US 9,828,661 B2
(45) Date of Patent: Nov. 28, 2017

(54) NICKEL-BASED SUPER HEAT RESISTANT ALLOY AND METHOD OF MANUFACTURING THE SAME

(71) Applicant: KOREA ATOMIC ENERGY RESEARCH INSTITUTE, Daejeon (KR)

(72) Inventors: Dong-Jin Kim, Daejeon (KR); Hong Pyo Kim, Daejeon (KR); Yun-Soo Lim, Daejeon (KR); Sung-Woo Kim, Daejeon (KR); Byung-Hak Moon, Gwangju (KR); Sujin Jung, Chungcheongbuk-do (KR)

(73) Assignee: Korea Atomic Energy Research Institute (KR)

( * ) Notice: Subject to any disclaimer, the term of this patent is extended or adjusted under 35 U.S.C. 154(b) by 207 days.

(21) Appl. No.: 14/515,675

(22) Filed: Oct. 16, 2014

(65) Prior Publication Data

US 2015/0252462 A1 Sep. 10, 2015

(30) Foreign Application Priority Data

Mar. 5, 2014 (KR) ..... 10-2014-0025897

(51) Int. Cl.

| | |
|---|---|
| ***C22C 19/05*** | (2006.01) |
| ***C22F 1/10*** | (2006.01) |
| ***C22C 19/00*** | (2006.01) |

(52) U.S. Cl.

CPC ..... *C22F 1/10* (2013.01); *C22C 19/007* (2013.01); *C22C 19/055* (2013.01)

(58) Field of Classification Search

CPC ..... C22C 19/055; C22F 1/10

See application file for complete search history.

(56) References Cited

U.S. PATENT DOCUMENTS

| | | | | |
|---|---|---|---|---|
| 3,260,505 A * | 7/1966 | Ver Snyder | B22C 9/04 | 148/404 |
| 4,292,076 A * | 9/1981 | Gigliotti | C30B 21/02 | 148/404 |
| 8,293,169 B2 * | 10/2012 | Semba | C22C 19/056 | 420/450 |

FOREIGN PATENT DOCUMENTS

| | | |
|---|---|---|
| JP | 2013-216939 | 10/2013 |
| KR | 10-0203379 B1 | 3/1999 |

* cited by examiner

*Primary Examiner* — Jessee Roe

(74) *Attorney, Agent, or Firm* — Sheridan Ross P.C.

(57) ABSTRACT

The present invention relates to a nickel-based super heat resistant alloy and a method of manufacturing the same. In the nickel-based super heat resistant alloy according to the present invention, an amount of solid solution strengthening elements (chromium, cobalt, molybdenum, or tantalum) is adjusted to improve a mechanical property, such as a creep property, at high temperatures, and aluminum or titanium is included in a predetermined amount to improve a corrosion property. The nickel-based super heat resistant alloy has excellent elongation, strength, and creep properties at normal temperature and high temperatures, and thus it is possible to manufacture parts of, by way of non-limiting example, a thermoelectric power plant, an aircraft, or a very high temperature reactor in various shapes on a large scale.

5 Claims, 2 Drawing Sheets

NICKEL-BASED SUPER HEAT RESISTANT ALLOY AND METHOD OF MANUFACTURING THE SAME

CROSS-REFERENCES TO RELATED APPLICATION

This patent application claims the benefit of priority from Korean Patent Application No. 10-2014-025897, filed on Mar. 5, 2014, the contents of which are incorporated herein by reference.

BACKGROUND OF THE INVENTION

1. Field of the Invention

The present disclosure relates to a nickel-based super heat resistant alloy and a method of manufacturing the same.

2. Description of the Related Art

Parts such as an engine and a gas turbine used in thermoelectric power plants or aircrafts are made of a nickel-based superalloy.

However, a crack or damage may occur due to use over a long period of time at high temperatures, and thus threat stability of the thermoelectric power plants and the aircrafts. Accordingly, research on a nickel-based superalloy having an improved creep property has been conducted.

Meanwhile, since a very high temperature reactor has high efficiency and economic feasibility as the very high temperature reactor is operated at high temperatures, research on embodiment of a very high temperature gas reactor by increasing an output temperature of a nuclear reactor to 950° C. to increase efficiency and further produce clean hydrogen using heat thereof has been actively conducted. Therefore, soundness of materials constituting the very high temperature reactor need to be maintained at very high temperatures.

Inactive helium gas having excellent thermal conductivity and absorbing neutrons in a small amount is used as a coolant of the very high temperature gas reactor, and heat exchanger parts for heat exchanging of a primary coolant and a secondary coolant are exposed to the most severe environment.

Currently, examples of a material considered as a material of a heat exchanger of the very high temperature reactor broadly include Alloy 617, Hastelloy XR, and Alloy 230. All of the examples is the nickel-based superalloy including nickel as a main element, among three types of materials, the most important Alloy 617 having an excellent mechanical property at high temperatures is actively evaluated in the US and France. In France, research on Alloy 230 as well as Alloy 617 has been conducted, and in Japan, research on Hastelloy XR has been mainly conducted.

According to current documents, there is no large difference in creep behavior at high temperatures of 900° C. or more for Alloy 617, Hastelloy XR, and Alloy 230. However, it is known that Alloy 230 is weak to carburizing when Alloy 230 is tested over a long period of time in a helium environment, and a deterioration speed of the material is fast in a very high temperature environment of 950° C. to serve as a limitation factor in maintenance of stability over a long period of time, and thus a solving method thereof is required.

It is known that helium considered as the coolant in the very high temperature reactor has an inactive property and may include an impurity in a small amount. However, the impurity included in helium serves as a factor causing corrosion of a surface of the very high temperature reactor in the very high temperature environment. Moisture and a hydrogen component are materials always included in helium due to system leakage and outgassing, and are reacted with carbon in the nuclear reactor to generate carbon monoxide and methane. Carbon monoxide and methane thusly produced may cause corrosion at high temperatures. Further, there may occur problems in that brittleness is increased during carburizing, and on the contrary, creep resistance is reduced during decarburizing.

Meanwhile, the alloys are not materials developed for the very high temperature gas reactor, but provided to be used in a wide high temperature range (600 to 850° C.). The superalloys improve temperature resistance at about 700 to 800° C. because a γ' (gamma prime) phase is present.

However, since the gamma prime phase is not stable at 950° C. that is a target temperature of the very high temperature environment, mechanical soundness cannot be secured at very high temperatures by the same method. Further, deterioration of the material is accelerated due to continuous corrosion. In order to perform a role as a structural material, high temperature creep resistance as well as a tensile property at normal temperature and high temperatures needs to be excellent.

As an existing technology relating to the nickel-based super heat resistant alloy, Korean Patent No. 10-0203379 discloses a nickel-based super heat resistant alloy for casting. Specifically, there is disclosed a nickel-based super heat resistant alloy for casting, including Ni as a basic composition and 6 to 10% of Cr, 8 to 13% of W, 1 to 4% of Mo, 3 to 7% of Al, 0.5 to 3% of Ti, 0.5 to 3% of Nb, 8 to 12% of Co, 3 to 7% of Ta, 0.05 to 2.0% of Hf, 0.05 to 2.0% of Zr, 0.01 to 0.1% of B, and 0.01 to 0.5% of C.

Accordingly, the present inventors have conducted a study of a method of improving a creep property and a corrosion property of the nickel-based super heat resistant alloy at high temperatures, and found that an amount of solid solution strengthening elements (Cr, Co, Mo, W, or Ta) is controlled and Al is included to improve the creep property and the corrosion property, thereby accomplishing the present invention.

SUMMARY OF THE INVENTION

One object of the present invention is to provide a nickel-based super heat resistant alloy.

Another object of the present invention is to provide a method of manufacturing a nickel-based super heat resistant alloy.

In order to achieve the objects, the present invention provides a nickel-based super heat resistant alloy including 20 to 25 wt % of chromium (Cr), 10 to 15 wt % of molybdenum (Mo), 10 to 17 wt % of cobalt (Co), 0.01 to 0.15 wt % of carbon (C), 0.01 to 1 wt % of zirconium (Zr), 0.01 to 1 wt % of hafnium (Hf), 0.01 to 5 wt % of tantalum (Ta), 1 to 100 ppm of boron (B), 0.01 to 1 wt % of aluminum (Al), and a balance of nickel (Ni).

The present invention also provides a method of manufacturing a nickel-based super heat resistant alloy, including mixing and melting raw materials including 20 to 25 wt % of chromium (Cr), 10 to 15 wt % of molybdenum (Mo), 10 to 17 wt % of cobalt (Co), 0.01 to 0.15 wt % of carbon (C), 0.01 to 1 wt % of zirconium (Zr), 0.01 to 1 wt % of hafnium (Hf), 0.01 to 5 wt % of tantalum (Ta), 1 to 100 ppm of boron (B), 0.01 to 1 wt % of aluminum (Al), and a balance of nickel (Ni) (step 1); hot-rolling the alloy melted in step 1 (step 2); solution-treating the alloy hot-rolled in step 2 (step 3); and cooling the solution-treated raw materials (step 4).

In the nickel-based super heat resistant alloy according to the present invention, an amount of solid solution strengthening elements (Cr, Co, Mo, or Ta) is adjusted to improve a mechanical property such as a creep property at high temperatures and aluminum (Al) is included in a predetermined amount to improve a corrosion property.

The nickel-based super heat resistant alloy has excellent elongation, strength, and creep property at normal temperature and high temperatures, and thus it is possible to manufacture parts of a thermoelectric power plant, an aircraft, and a very high temperature reactor in various shapes on a large scale. Particularly, in a very high temperature gas nuclear power generation attracting attention as a next-generation nuclear power generation, the nickel-based super heat resistant alloy can be used for parts of a heat exchanger for heat exchanging of helium used as a primary coolant and helium used as a secondary coolant.

BREIF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
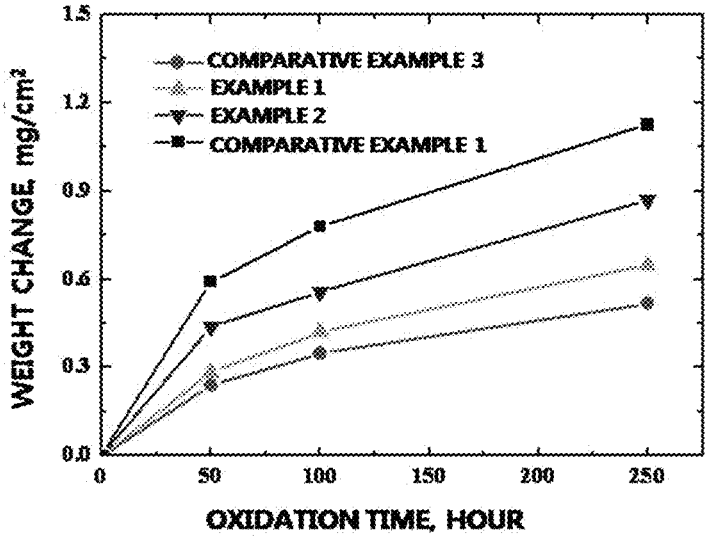
FIG. 1 is a graph showing a weight change amount of nickel-based super heat resistant alloys manufactured in Examples 1 and 2 and Comparative Examples 1 and 3 according to a corrosion test time.

The present invention provides a nickel-based super heat resistant alloy including 20 to 25 wt % of chromium (Cr), 10 to 15 wt % of molybdenum (Mo), 10 to 17 wt % of cobalt (Co), 0.01 to 0.15 wt % of carbon (C), 0.01 to 1 wt % of zirconium (Zr), 0.01 to 1 wt % of hafnium (Hf), 0.01 to 5 wt % of tantalum (Ta), 1 to 100 ppm of boron (B), 0.01 to 1 wt % of aluminum (Al), and a balance of nickel (Ni).

Hereinafter, the nickel-based super heat resistant alloy according to the present invention will be described in detail.

Generally, superalloys improve temperature resistance at about 700 to 800° C. because a γ' (gamma prime) phase is present. However, the gamma prime phase is not stable at 950° C. which is a target temperature of a very high temperature environment. Moreover, there may occur a problem in that deterioration of a material is accelerated due to continuous corrosion at high temperatures.

Accordingly, the present invention has been made in an effort to solve this problem, and it is an object of the present invention to manufacture a Ni—Cr—Co—Mo alloy having an improved corrosion property by appropriately adjusting a content of aluminum (Al) or titanium (Ti) as an element having excellent oxidation resistance, having an improved creep property by adjusting an amount of solid solution strengthening elements (Cr, Co, Mo, or Ta), and including zirconium (Zr) and hafnium (Hf) to secure strengthening of grain boundaries and tantalum (Ta) to improve a heat resistant property and a solid solution strengthening effect.

It is preferable that the content of chromium (Cr) be 20 to 25 wt %.

Chromium improves corrosion resistance in the super heat resistant alloy because an oxidation speed is limited due to solid solution strengthening and stability of a chromium oxide film, and promote formation of carbides, but may generate a TCP (topologically close packed) phase. When chromium is added in the content of less than 20 wt %, there is a problem in that corrosion resistance is reduced, and when chromium is added in the content of more than 25 wt %, there is a problem in that the TCP phase negatively affecting a mechanical property may be generated during exposure at high temperatures over a long period of time.

It is preferable that the content of molybdenum (Mo) be 10 to 15 wt %.

Molybdenum is a solid solution strengthening element, that is, an element improving a high temperature property of the super heat resistant alloy, and forms stable carbides at higher temperatures, but when a large amount of molybdenum is added, density may be increased and the TCP phase may be generated. When the content is less than 10 wt %, there is a problem in that the solid solution strengthening effect is not expected, and when molybdenum is added in the content of more than 15 wt %, there is a problem in that generation of the TCP phase is promoted.

It is preferable that the content of cobalt (Co) be 10 to 17 wt %.

Cobalt (Co) is a solid solution strengthening element, that is, an element improving the high temperature property of the super heat resistant alloy, such as the creep property, when the content of cobalt is less than 10 wt %, there is a problem in that the creep property is reduced, and when the content is more than 17 wt %, generation of the TCP phase may be promoted.

It is preferable that the content of carbon (C) be 0.01 to 0.15 wt %.

Carbon (C) is an element performing a very important role on a mechanical property, and increases strength due to precipitation of carbides and melting in the alloy. There are problems in that when carbon is included in the content of less than 0.01 wt %, an effect thereof is insignificant, and when carbon is included in the content of more than 0.15 wt %, brittleness of a material may be increased.

It is preferable that the content of zirconium (Zr) be 0.01 to 1 wt %.

Zirconium (Zr) is an element improving strengthening of grain boundaries of the super heat resistant alloy according to the present invention. When the content of zirconium (Zr) is less than 0.01 wt %, there is a problem in that since the content is low, a grain boundary strengthening effect is insignificant, and when the content is more than 1 wt %, there are problems in that the grain boundary strengthening effect is not secured any more and zirconium may affect deterioration of the mechanical property in addition to strengthening of grain boundaries.

It is preferable that the content of hafnium (Hf) be 0.01 to 1 wt %.

Hafnium (Hf) is an element reducing strengthening of grain boundaries and stacking fault energy of the super heat resistant alloy according to the present invention. When the content of hafnium (Hf) is less than 0.01 wt %, there is a problem in that since the content is low, the grain boundary strengthening effect is insignificant, and when the content is more than 1 wt %, there are problems in that the grain boundary strengthening effect is not secured any more and hafnium may affect deterioration of the mechanical property in addition to strengthening of grain boundaries.

It is preferable that the content of tantalum (Ta) be 0.01 to 5 wt %.

Tantalum (Ta) is an element increasing creep resistance through solid solution strengthening, promoting formation of carbides, reducing stacking fault energy, and improving corrosion resistance by forming a dense oxide film having excellent heat resistance. When the content of tantalum is less than 0.01 wt %, there is a problem in that since the content is low, improvement of corrosion resistance is insignificant, and when the content is more than 5 wt %, there is a problem in that generation of the complicated TCP phase is promoted.

It is preferable that the content of boron (B) be 1 to 100 ppm.

Boron (B) is an element performing strengthening of grain boundaries. There are problems in that when the content of boron (B) is less than 1 ppm, an effect is insignificant, and when the content is more than 100 ppm, brittleness is increased.

It is preferable that the content of aluminum (Al) be 0.01 to 1 wt %.

Aluminum contributes to improvement of oxidation resistance of the nickel-based super heat resistant alloy.

There are problems in that when the content of aluminum is less than 0.01 wt %, an effect thereof is insignificant, and when the content is more than 1 wt %, the mechanical property may be reduced at a very high temperature of 900° C. or more due to excessive precipitation of the γ' phase. Further, diffusion of oxygen through a grain boundary becomes slow.

The nickel-based super heat resistant alloy may further include 0.01 to 1 wt % of titanium (Ti).

Like aluminum, titanium helps to improve oxidation resistance. There may occur problems in that when the content is of titanium is less than 0.01 wt %, an effect thereof is insignificant, and when titanium is added in the content of more than 1 wt %, an unnecessary phase such as a η phase is generated to reduce oxidation resistance.

The nickel-based super heat resistant alloy may further include 0.1 to 5 wt % of tungsten (W).

Creep strength of the nickel-based super heat resistant alloy may be increased due to solid solution strengthening by adding tungsten.

When the nickel-based super heat resistant alloy includes tungsten in the content of less than 0.1 wt %, an improvement effect of creep strength is insignificant, and when tungsten is included in the content of more than 5 wt %, density is increased, toughness and corrosion resistance are reduced, and phase stability is reduced. Further, during single crystal and unidirectional coagulation, a possibility of generation of cast defects such as freckles is increased.

In the nickel-based super heat resistant alloy according to the present invention, a weight of the nickel-based super heat resistant alloy may be changed by 1.0 mg/cm$^2$ or less in a high temperature air condition of 950° C. during an oxidation time of 250 hours.

Alloy 617, Hastelloy XR, and Alloy 230 as an existing alloy which can be used at high temperatures are not a material developed for a very high temperature gas reactor, but provided to be used in a wide high temperature range (600 to 850° C.). A γ' (gamma prime) phase constituted by $Ni_3Al$ (Ti), which is one of important strengthening mechanisms of the alloys, improves temperature resistance at about 700 to 800° C., but since the gamma prime phase is not stable at 950° C. that is the target temperature of the very high temperature environment, deterioration of the mechanical property may occur.

On the other hand, since the nickel-based super heat resistant alloy according to the present invention uniformly forms the oxide film having adhesion strength in a corrosion environment by appropriately adjusting contents of aluminum (Al) or aluminum and titanium (Ti) having excellent oxidizing power, the weight may be changed by 1.0 mg/cm$^2$ or less in a high temperature air condition of 950° C. during an oxidation time of 250 hours.

Further, the nickel-based super heat resistant alloy according to the present invention includes chromium (Cr) and tantalum (Ta), and chromium may generate the oxide film to limit the oxidation speed due to stability of the oxide film and thus improve corrosion resistance in the super heat resistant alloy. Tantalum may form the dense oxide film having excellent heat resistance, and thus corrosion resistance of the alloy according to the present invention may be improved.

Further, the nickel-based super heat resistant alloy according to the present invention may include zirconium (Zr) and hafnium (Hf) to perform strengthening of grain boundaries of the alloy according to the present invention by the aforementioned elements. That is, diffusion of oxygen along the grain boundary may become slow by the aforementioned elements, and thus the oxidation speed may be further reduced.

Moreover, if additional heat-treating is performed when the nickel-based super heat resistant alloy according to the present invention is manufactured, the grain boundary may be further strengthened to additionally reduce a corrosion speed.

In the nickel-based super heat resistant alloy according to the present invention, the nickel-based super heat resistant alloy may have the creep property of 1000 hours or more when stress of 30 MPa is applied in the air at 950° C. under a high temperature condition.

The high creep property may be secured by adjusting an amount of solid solution strengthening elements (Cr, Co, Mo, or Ta) such as cobalt, tantalum, or aluminum.

The present invention provides a method of manufacturing a nickel-based super heat resistant alloy, including mixing and melting raw materials including 20 to 25 wt % of chromium (Cr), 10 to 15 wt % of molybdenum (Mo), 10 to 17 wt % of cobalt (Co), 0.01 to 0.15 wt % of carbon (C), 0.01 to 1 wt % of zirconium (Zr), 0.01 to 1 wt % of hafnium (Hf), 0.01 to 5 wt % of tantalum (Ta), 1 to 100 ppm of boron (B), 0.01 to 1 wt % of aluminum (Al), and a balance of nickel (Ni) (step 1); hot-rolling the alloy melted in step 1 (step 2); solution-treating the alloy hot-rolled in step 2 (step 3); and cooling the solution-treated raw materials (step 4).

Hereinafter, the method of manufacturing the nickel-based super heat resistant alloy according to the present invention will be described in detail for each step.

In the method of manufacturing the nickel-based super heat resistant alloy according to the present invention, step 1 is a step of mixing and melting the raw materials including 20 to 25 wt % of chromium (Cr), 10 to 15 wt % of molybdenum (Mo), 10 to 17 wt % of cobalt (Co), 0.01 to 0.15 wt % of carbon (C), 0.01 to 1 wt % of zirconium (Zr), 0.01 to 1 wt % of hafnium (Hf), 0.01 to 5 wt % of tantalum (Ta), 1 to 100 ppm of boron (B), 0.01 to 1 wt % of aluminum (Al), and the balance of nickel (Ni).

In step 1, the raw materials may be mixed and melted in molten metal to manufacture the alloy including the uniformly mixed raw materials.

In this case, in step 1, it is preferable that 0.01 to 1 wt % of titanium (Ti) be further included as the raw material.

Like aluminum, titanium helps to improve oxidation resistance, that is, a corrosion property. There may occur problems in that when the content is of titanium is less than 0.01 wt %, an effect thereof is insignificant, and when titanium is added in the content of more than 1 wt %, an unnecessary phase such as a η phase is generated to reduce oxidation resistance.

Further, in step 1, it is preferable that 0.1 to 5 wt % of tungsten (W) be further included as the raw material.

Creep strength of the nickel-based super heat resistant alloy may be increased due to solid solution strengthening by adding tungsten.

When the nickel-based super heat resistant alloy includes tungsten in the content of less than 0.1 wt %, an improvement effect of creep strength is insignificant, and when tungsten is included in the content of more than 5 wt %, density is increased, toughness and corrosion resistance are reduced, and phase stability is reduced. Further, during single crystal and unidirectional coagulation, a possibility of generation of cast defects such as freckles is increased.

Further, the melting of step 1 may be performed by a vacuum induction melting method, but the melting method is not limited thereto.

When the vacuum induction melting method is used, metal may be melted in a vacuum to prevent an impurity from being added to oxygen.

In the method of manufacturing the nickel-based super heat resistant alloy according to the present invention, step 2 is a step of hot-rolling the alloy melted in step 1.

In this case, it is preferable that the hot-rolling be performed at a reduction ratio of 50% or more at 1000 to 1200° C.

When the hot-rolling is performed at a temperature of less than 1000° C., there is a problem in that it is difficult to form a precipitate, and when the hot-rolling is performed at a temperature of more than 1200° C., there is a problem in that since strength of the material is low, the rolling is not appropriately performed.

In the method of manufacturing the nickel-based super heat resistant alloy according to the present invention, step 3 is a step of solution-treating the alloy hot-rolled in step 2.

The solution-treating is treatment in which steel is heated to a solid solution range and then rapidly cooled to maintain a solid solution state to normal temperature, and the alloy elements may be easily subjected to solid solution therethrough.

In this case, it is preferable that the solution-treating be performed at 1150 to 1200° C. When the solution-treating is performed outside the aforementioned range, there is a problem in that since the precipitate is not totally melted, a desired property is not secured.

In the method of manufacturing the nickel-based super heat resistant alloy according to the present invention, step 4 is a step of cooling the solution-treated alloy.

In the method of manufacturing the nickel-based super heat resistant alloy according to the present invention, it is preferable that the method further include performing heat-treating after step 3 is performed.

When additional heat-treating is performed, there is an effect of additionally strengthening the grain boundary. In this case, the alloy element components, such as carbon and chromium, which are subjected to solid solution strengthening, form the precipitate according to heat-treating, and thus there is a loss in terms of a solid solution strengthening effect, but it is assumed that an additional precipitation strengthening effect occurs, and thus the mechanical property is changed due to equilibrium of the two effects.

It is preferable that the heat-treating be performed at 1000 to 1150° C. for 0.5 to 5 hours. In the case of deviation from the aforementioned range, there is a problem in that since a stable region of the precipitate is not secured, generation and growth of the precipitate are disturbed, and thus a target effect may not be sufficiently secured.

Meanwhile, the cooling performed after the heat-treating according to the present invention may be performed by using a water cooling method, but the cooling method is not limited thereto.

Moreover, the nickel-based super heat resistant alloy may be used for any one type selected from the group consisting of parts for heat exchangers for very high temperature reactors, an engine for aircrafts, and a gas turbine for thermoelectric power plants.

In the present invention, the nickel-based super heat resistant alloy has excellent mechanical and corrosion properties as a creep property at normal temperature and a high temperature of 950° C., and thus the parts of the thermoelectric power plants, the aircrafts, and the very high temperature reactors used at high temperatures can be manufactured in various shapes on a large scale. Therefore, the nickel-based super heat resistant alloy according to the present invention is thermodynamically stable even at a high temperature of 950° C., thus being used for a gas turbine of the thermoelectric power plant, an engine of the aircraft, and the very high temperature reactor having high efficiency and excellent economic feasibility.

For example, in a very high temperature gas nuclear power generation attracting attention as a next-generation nuclear power generation, the nickel-based super heat resistant alloy according to the present invention can be used for parts of a heat exchanger for heat exchanging of helium used as a primary coolant and helium used as a secondary coolant.

Hereinafter, the present invention will be described in more detail with reference to the specific Examples and Experimental Examples. However, the following Examples and Experimental Examples are provided for illustrative purposes only, and the scope of the present invention should not be limited thereto in any manner.

EXAMPLE 1

Step 1: Through vacuum induction melting, the alloy having the composition of 22 wt % of chromium (Cr), 13 wt % of molybdenum (Mo), 15 wt % of cobalt (Co), 0.1 wt % of zirconium (Zr), 0.1 wt % of hafnium (Hf), 0.5 wt % of tantalum (Ta), 30 ppm of boron (B), 0.1 wt % of manganese (Mn), 0.08 wt % of carbon (C), 1 wt % of aluminum (Al), and the balance of nickel (Ni) was manufactured.

Heat-treating was performed at 1200° C. for 24 hours to perform homogeneous heat-treating of the alloy, and water-cooling was then performed in the air.

Step 2: The alloy melted in step 1 was hot-rolled by 50% three times at 1050 to 1150° C., and then rapidly water-cooled.

Step 3: The alloy hot-rolled in step 2 was solution-treated at 1175° C. for 30 minutes, and then rapidly water-cooled in the air.

Step 4: The alloy solution-treated in step 3 was heat-treated at 1110° C. for 1 hour and then water-cooled in the air to manufacture the nickel-based super heat resistant alloy.

EXAMPLE 2

The same procedure as Example 1 was performed to manufacture the nickel-based super heat resistant alloy, except that the alloy having the composition further including 0.1 wt % of titanium (Ti) was manufactured in step 1 of Example 1.

EXAMPLE 3

The same procedure as Example 1 was performed to manufacture the nickel-based super heat resistant alloy, except that step 4 of Example 1 was not performed.

COMPARATIVE EXAMPLE 1

The same procedure as Example 1 was performed to manufacture the nickel-based super heat resistant alloy, except that the alloy having the same composition as the commercial nickel-based alloy (22 wt % of chromium (Cr), 10 wt % of molybdenum (Mo), 12 wt % of cobalt (Co), 30 ppm of boron (B), 0.1 wt % of manganese (Mn), 0.08 wt % of carbon (C), 1.12 wt % of aluminum (Al), 0.35 wt % of titanium (Ti), 1.5 wt % of iron (Fe), and the balance of nickel (Ni)) in step 1 of Example 1 was manufactured and step 4 was not performed.

COMPARATIVE EXAMPLE 2

The commercial nickel-based alloy (22 wt % of chromium (Cr), 10 wt % of molybdenum (Mo), 12 wt % of cobalt (Co), 30 ppm of boron (B), 0.1 wt % of manganese (Mn), 0.08 wt % of carbon (C), 1.12 wt % of aluminum (Al), 0.35 wt % of titanium (Ti), 1.5 wt % of iron (Fe), and the balance of nickel (Ni)) was used.

COMPARATIVE EXAMPLE 3

The same procedure as Example 1 was performed to manufacture the nickel-based super heat resistant alloy, except that aluminum was not included in step 1 of Example 1.

COMPARATIVE EXAMPLE 4

The same procedure as Example 1 was performed to manufacture the nickel-based super heat resistant alloy, except that aluminum was not included in step 1 of Example 1 and step 4 was not performed.

EXPERIMENTAL EXAMPLE 1

Corrosion Resistance of the Nickel-based Super Heat Resistant Alloy

Figure 2:
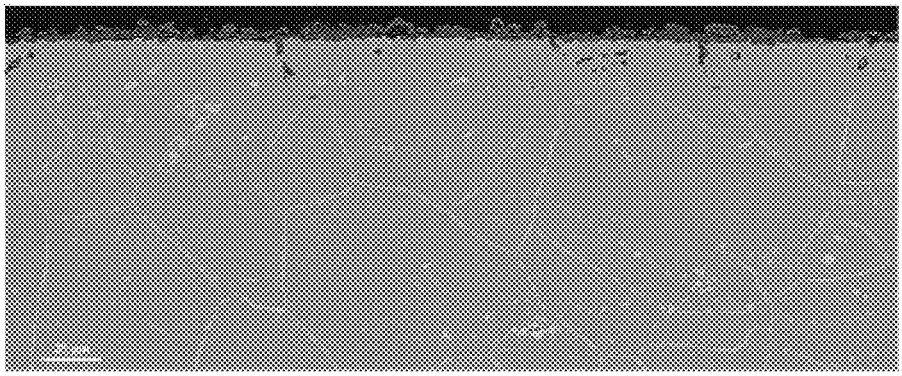
FIG. 2 is a picture obtained by observing a cross-section of the nickel-based super heat resistant alloy manufactured in Comparative Example 3 by a scanning electron microscope.
Figure 3:
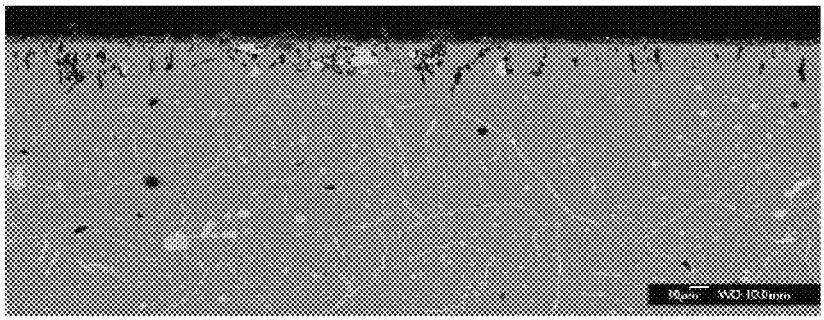
FIG. 3 is a picture obtained by observing a cross-section of the nickel-based super heat resistant alloy manufactured in Example 1 by the scanning electron microscope.
Figure 4:
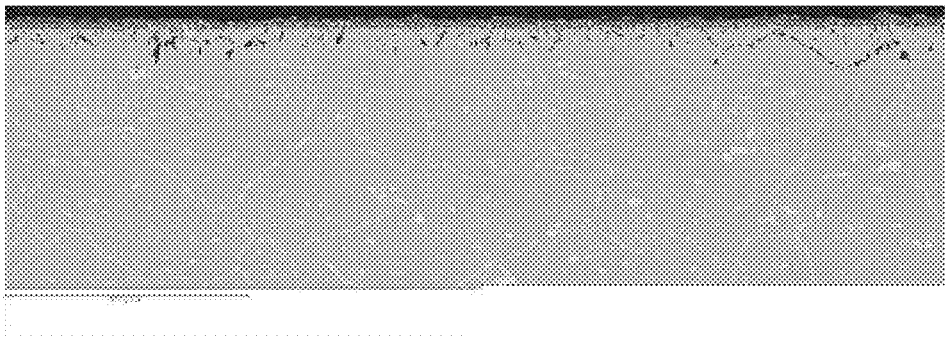
FIG. 4 is a picture obtained by observing a cross-section of the nickel-based super heat resistant alloy manufactured in Example 2 by the scanning electron microscope.

The result of the weight change amount measured before and after the corrosion test in the air at 950° C. in order to check corrosion resistance of the nickel-based super heat resistant alloys manufactured in Examples 1 and 2 and Comparative Examples 1 and 3 is shown in FIG. 1, the cross-section after the corrosion test of Examples 1 and 2 and Comparative Example 3 was observed by the scanning electron microscope, and the result is shown in FIGS. 2 to 4.

As shown in FIG. 1, when the material is corroded in the environment of the air at high temperatures, the weight change amount has an arc relationship with time as shown in the following Equation 1.

$$\left(\frac{\Delta m}{S}\right)^2 = k_p \cdot t + c \qquad \text{(Equation 1)}$$

That is, when corrosion largely occurs, a weight increase amount is further increased according to time, and when corrosion resistance is high, the weight increase amount is reduced.

In the case of Comparative Example 1, when oxidation was performed for 250 hours, the weight was changed by 1.1 mg/cm$^2$, which showed lowest corrosion resistance, and in Examples 1 and 2, the weights were changed by 0.9 and 0.7 mg/cm$^2$, which were lower than the weight change of Comparative Example 1. On the other hand, in Comparative Example 3, the weight was changed by 0.5 mg/cm$^2$.

In results shown in FIGS. 2 to 4, in Comparative Example 3, a thickness of an oxide film formed on a mother material is not uniform but uneven, and interfacial adhesion is poor. That is, when adhesion between the oxide film and the mother material is poor and thus the oxide film is separated from the mother material during the corrosion test, the weight increase amount is reduced to reduce an apparent corrosion speed. However, larger corrosion may occur on the mother material from which the oxide film is separated.

On the other hand, in the case of Examples 1 and 2, the oxide film is uniformly formed on the mother material and adhesion is favorable, and thus the oxide film serves as a barrier on which corrosion does not occur.

TABLE 1

Unit: wt %

| | Cr | Mo | Co | Zr | Hf | Ta | B (ppm) | Mn | C | Al | Ti | Fe | Ni | Heat-treating of step 4 |
|---|---|---|---|---|---|---|---|---|---|---|---|---|---|---|
| Example 1 | 22 | 13 | 15 | 0.1 | 0.1 | 0.5 | 30 | 0.1 | 0.08 | 1 | — | — | Bal | ○ |
| Example 2 | 22 | 13 | 15 | 0.1 | 0.1 | 0.5 | 30 | 0.1 | 0.08 | 1 | 0.1 | — | Bal | ○ |
| Example 3 | 22 | 13 | 15 | 0.1 | 0.1 | 0.5 | 30 | 0.1 | 0.08 | 1 | — | — | Bal | x |
| Comparative Example 1 | 22 | 10 | 12 | — | — | — | 30 | 0.1 | 0.08 | 1.12 | 0.35 | 1.5 | Bal | x |
| Comparative Example 2 (commercial alloy) | 22 | 10 | 12 | — | — | — | 30 | 0.1 | 0.08 | 1.12 | 0.35 | 1.5 | Bal | x |
| Comparative Example 3 | 22 | 13 | 15 | 0.1 | 0.1 | 0.5 | 30 | 0.1 | 0.08 | — | — | — | Bal | ○ |
| Comparative Example 4 | 22 | 13 | 15 | 0.1 | 0.1 | 0.5 | 30 | 0.1 | 0.08 | — | — | — | Bal | x |

Accordingly, it can be confirmed that in the case where aluminum or aluminum and titanium are included, the oxide film is uniformly formed and has excellent adhesion to the mother material, and thus corrosion resistance is high.

EXPERIMENTAL EXAMPLE 2

Creep Property of the Nickel-based Super Heat Resistant Alloy

The creep test was performed with stress of 30 MPa at 950° C. by using the scanning electron microscope in order to check the creep property of the nickel-based super heat resistant alloys manufactured in Example 3 and Comparative Examples 2 and 4, and times taken until rupture is described in Table 2.

TABLE 2

| | Rupture time (hr) |
|---|---|
| Example 3 | 1080 |
| Comparative Example 2 | 527 |
| Comparative Example 4 | 894 |

As described in Table 1, in the case of Example 3, the rupture time is 1080 hours, and in the case of Comparative Examples 2 and 3, the rupture time is 527 hours and 894 hours.

Accordingly, it can be seen that the nickel-based alloy further including aluminum of the present invention has the excellent creep property as compared to the commercial alloy.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A nickel-based heat resistant alloy comprising:

20 to 25 wt % of chromium (Cr), 10 to 15 wt % of molybdenum (Mo), 10 to 17 wt % of cobalt (Co), 0.01 to 0.15 wt % of carbon (C), 0.01 to 1 wt % of zirconium (Zr), 0.01 to 1 wt % of hafnium (Hf), 0.01 to 5 wt % of tantalum (Ta), 1 to 100 ppm of boron (B), 0.01 to 1 wt % of aluminum (Al), and a balance of nickel (Ni), wherein the nickel-based heat resistant alloy is polycrystalline and does not comprise titanium (Ti) or an aligned eutectic reinforcing fibrous phase.

2. The nickel-based heat resistant alloy as set forth in claim 1, further comprising:

0.1 to 5 wt % of tungsten (W).

3. The nickel-based heat resistant alloy as set forth in claim 1, wherein a weight of the nickel-based heat resistant alloy is changed by 1.0 $mg/cm^2$ or less under a high temperature air condition of 950° C. during an oxidation time of 250 hours.

4. The nickel-based heat resistant alloy as set forth in claim 1, wherein the nickel-based heat resistant alloy has a creep property of 1000 hours or more under a high temperature condition of 950° C.

5. The nickel-based heat resistant alloy as set forth in claim 1, wherein the nickel-based heat resistant alloy is used for any one type selected from the group consisting of parts for heat exchangers for reactors configured to operate at temperatures of at least 950° C., an engine for aircrafts, and a gas turbine for thermoelectric power plants.

* * * * *